US012225978B2

(12) United States Patent
Perrin et al.

(10) Patent No.: US 12,225,978 B2
(45) Date of Patent: Feb. 18, 2025

(54) ANATOMICAL PADDING FOR A SHOE

(71) Applicant: adidas AG, Herzogenaurach (DE)

(72) Inventors: Valentin Perrin, Nuremberg (DE); Ellis Koenig, Nuremberg (DE)

(73) Assignee: adidas AG, Herzogenaurach (DE)

( * ) Notice: Subject to any disclaimer, the term of this patent is extended or adjusted under 35 U.S.C. 154(b) by 135 days.

(21) Appl. No.: 17/965,721

(22) Filed: Oct. 13, 2022

(65) Prior Publication Data

US 2023/0117040 A1 Apr. 20, 2023

(30) Foreign Application Priority Data

Oct. 14, 2021 (DE) ..... 102021211608.6

(51) Int. Cl.

| | |
|---|---|
| ***A43B 7/14*** | (2022.01) |
| ***A43B 7/1405*** | (2022.01) |
| ***A43B 7/20*** | (2006.01) |
| ***A43B 23/02*** | (2006.01) |
| ***A43B 23/07*** | (2006.01) |

(52) U.S. Cl.

CPC ..... *A43B 23/028* (2013.01); *A43B 7/14* (2013.01); *A43B 7/1405* (2013.01); *A43B 7/20* (2013.01); *A43B 23/07* (2013.01)

(58) Field of Classification Search

CPC ..... A43B 23/07; A43B 7/20; A43B 7/1405; A43B 7/14

USPC ..... 36/71, 89

See application file for complete search history.

(56) References Cited

U.S. PATENT DOCUMENTS

| | | | | |
|---|---|---|---|---|
| 1,926,818 A * | 9/1933 | Rateliff | A43B 23/28 36/58.5 |
| 1,966,179 A * | 7/1934 | Lesch | A43B 23/28 36/58.5 |
| 3,299,893 A * | 1/1967 | Collina | A43B 7/26 36/140 |
| 3,419,974 A * | 1/1969 | Lange | A43B 5/0405 36/117.6 |
| 5,430,961 A * | 7/1995 | Faulconer | A43B 3/0063 36/71 |

(Continued)

FOREIGN PATENT DOCUMENTS

| | | |
|---|---|---|
| DE | 3823513 A1 | 1/1990 |
| DE | 69009555 T2 | 9/1994 |

(Continued)

OTHER PUBLICATIONS

Office Action, German Patent Application No. 102021211608.6, May 16, 2022, 15 pages.

(Continued)

*Primary Examiner* — Marie D Bays

(74) *Attorney, Agent, or Firm* — Kilpatrick Townsend & Stockton LLP

(57) ABSTRACT

The present invention relates to an upper for a shoe, comprising: a medial padding located in a medial portion of a heel area of the upper, wherein the medial padding comprises a first shape; a lateral padding located in a lateral portion of the heel area of the upper, wherein the lateral padding comprises a second shape; wherein the first shape differs from the second shape, wherein the lateral padding is arranged closer to a sole of the shoe than the medial padding, and wherein the lateral padding is arranged closer to a rear of the shoe upper than the medial padding.

21 Claims, 2 Drawing Sheets

(56) References Cited

U.S. PATENT DOCUMENTS

| | | | | |
|---|---|---|---|---|
| 5,449,005 | A * | 9/1995 | Echols | A43B 7/20 36/89 |
| 5,778,563 | A | 7/1998 | Ahlbaumer | |
| 5,842,292 | A * | 12/1998 | Siesel | A43B 23/28 36/71 |
| 5,985,383 | A * | 11/1999 | Allen | A43B 19/00 525/218 |
| 6,079,128 | A * | 6/2000 | Hoshizaki | A43B 23/16 36/89 |
| 6,101,655 | A * | 8/2000 | Buddle | A43B 23/28 12/146 D |
| 6,442,875 | B1 | 9/2002 | Joubert et al. | |
| 7,028,419 | B2 * | 4/2006 | Brooks | A43B 23/07 36/89 |
| 7,140,128 | B2 | 11/2006 | Huckle | |
| 7,513,066 | B2 | 4/2009 | Kokstis et al. | |
| 9,788,596 | B2 * | 10/2017 | Schenone | A43B 3/26 |
| 2002/0020081 | A1 * | 2/2002 | Brooks | A43B 23/07 36/95 |
| 2002/0083622 | A1 * | 7/2002 | Joubert | A43B 7/141 36/117.6 |
| 2004/0111923 | A1 * | 6/2004 | Brooks | A43B 7/14 36/89 |
| 2005/0252040 | A1 * | 11/2005 | Huckle | A43B 7/12 36/89 |
| 2006/0130369 | A1 | 6/2006 | Christensen et al. | |
| 2010/0319217 | A1 * | 12/2010 | Echols | A43B 7/20 36/35 B |
| 2015/0289589 | A1 * | 10/2015 | Nishiwaki | A43B 7/141 36/92 |
| 2016/0250099 | A1 | 9/2016 | Eim et al. | |
| 2021/0259364 | A1 * | 8/2021 | Takashima | A43B 23/0275 |

FOREIGN PATENT DOCUMENTS

| | | | |
|---|---|---|---|
| EP | 0350517 | A1 | 1/1990 |
| JP | H08-510652 | A | 11/1996 |
| JP | H09-511162 | A | 11/1997 |
| JP | 4714329 | B2 | 6/2011 |
| KR | 1020080057821 | A | 6/2008 |
| KR | 101300896 | B1 | 8/2013 |

OTHER PUBLICATIONS

Office Action, Japanese Patent Application No. 2022-164463, Nov. 21, 2023, 8 pages.

European Extended Search Report, European Patent Application No. 22201653.7, Feb. 1, 2023, 8 pages.

Office Action, Japanese Patent Application No. 2022-164463, May 28, 2024, 5 pages.

Decision of Rejection, Japanese Patent Application No. 2022-164463, Sep. 24, 2024, 6 pages.

* cited by examiner

ANATOMICAL PADDING FOR A SHOE

CROSS REFERENCE TO RELATED APPLICATION

This application is related to and claims priority benefits from German Patent Application No. DE 10 2021 211 608.6, filed on Oct. 14, 2022, entitled Anatomical padding for a shoe ("the '608 application"). The '608 application is hereby incorporated herein in its entirety by this reference.

FIELD OF THE INVENTION

The present invention relates to an upper for a shoe comprising asymmetrical paddings and a method of manufacturing an upper for a shoe with asymmetrical paddings.

BACKGROUND

Shoes must be made of durable materials to protect the foot and ensure a certain durability. In order for a shoe to maintain its shape and provide sufficient support for its wearer, the base material of the shoe must be relatively stiff. As to prevent the foot from being injured by this relatively hard base material when worn, padding and/or lining is used. The padding and/or lining may extend uniformly inside an upper of the shoe. However, the lining and in particular the padding may be beneficial for a variety of additional requirements.

In general, a padding may be designed in the shoe depending on the intended purpose of the shoe. One purpose is to avoid pressure peaks and, thus, blisters and/or abrasions. Another purpose is an optimal distribution of the pressure of the foot in the shoe. Additionally, a padding may also have a corrective effect on foot position. In a medical application a padding may compensate foot malposition, which may otherwise lead to malposition of the entire Musculoskeletal system.

Those considerations are especially important in the area of the ankle, because in this area a snug fit of the foot is very important, since too much freedom of movement of the foot in the shoe may lead to injuries. Furthermore, without a special support there is a high risk that the wearer twists his/her ankle. In addition, the ankle's rather pronounced protrusions on both sides of the leg caused by the ends of fibula and tibia and the absence of muscles and fat in this area quickly lead to abrasions without a proper cushioning.

Conventional shoes usually have symmetrical paddings around the ankles on both sides of the leg and use the same padding shape on the medial and lateral side, which does not correspond to the anatomical conditions of the foot. This leads to a reduced fit, in addition to an unpleasant wearing comfort, and in the worst case to a malposition, as the wearer tries to adapt his walking style to the not ideal fitting shoe.

It is therefore an object of the present invention to provide a padding for a shoe, which provides an ideal fit around the ankle of a wearer based on the anatomical conditions.

JP 04714329 B2 is directed to a sole-plate, insole insert, and footwear which correct the flatfoot, the talipes valgus, and the clubfoot.

U.S. Pat. No. 7,140,128 B2 relates to J-bars that are located on either side of a boot above a heel. The J-bars also contain memory material and are located and shaped to extend beneath and to a rear of an ankle bone of the user.

U.S. Pat. No. 6,442,875 B1 is directed to provide a boot upper having a lateral quarter and a medial quarter which are asymmetric and mostly rigid.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

In some embodiments, the present disclosure is directed to an upper for a shoe, comprising: a) a medial padding located in a medial portion of a heel area of the upper, wherein the medial padding comprises a first shape; b) a lateral padding located in a lateral portion of the heel area of the upper, wherein the lateral padding comprises a second shape; c) wherein the first shape differs from the second shape, d) wherein the lateral padding) is arranged closer to a sole of the shoe than the medial padding, and e) wherein the lateral padding is arranged closer to a rear of the shoe upper than the medial padding. The medial padding thickness may be smaller than a thickness of the lateral padding, such as at least 4 mm smaller. The lateral padding length may be less than a length of the medial padding, such as at least 2 mm less. The width of the lateral padding may be greater than a width of the medial padding, such as at least 2 mm greater. The volume of the medial padding may differ from the volume of the lateral padding. In some aspects, the volume of the medial padding is smaller than the volume of the lateral padding. The lateral padding may be arranged at least 2 mm closer to a sole of the shoe than the medial padding. The lateral padding may be arranged at least 6 mm closer to a rear of the shoe upper than the medial padding. The medial padding may comprise a foam material. The lateral padding may comprise a foam material. The medial padding and/or the lateral padding may comprise a pod. In some aspects, the pod is filled with a liquid and/or a gas. The present disclosure is also directed to a shoe comprising a sole attached to the upper described herein.

In some embodiments, the present disclosure is directed to a method of manufacturing an upper for a shoe, comprising: a) arranging a medial padding in a medial portion of a heel area of the upper; wherein the medial padding comprises a first shape; b) arranging a lateral padding in a lateral portion of the heel area of the upper, wherein the lateral padding comprises a second shape, c) wherein the first shape differs from the second shape; d) arranging the lateral padding closer to a sole of the shoe than the medial padding, and e) arranging the lateral padding closer to a rear of the shoe upper than the medial padding. The method may further comprise the step of providing the medial padding and/or the lateral padding with a pod. The method may further comprise the steps of: providing a vacuum forming machine having a top mold and a bottom mold with a cavity; placing a first sheet on the bottom mold; pulling a portion of the sheet into the bottom mold using vacuum applied to the cavity of the bottom mold to obtain a pod-shaped structure;

filling the pod-shaped structure with a filler material; covering the filled pod-shaped structure with a second sheet; and sealing the pod-shaped structure by pressing the top mold against the bottom mold to obtain a filled pod.

BRIEF DESCRIPTION OF THE DRAWINGS

In the following detailed description, embodiments of the invention are described referring to the following figures.

BRIEF DESCRIPTION

Figure 1:
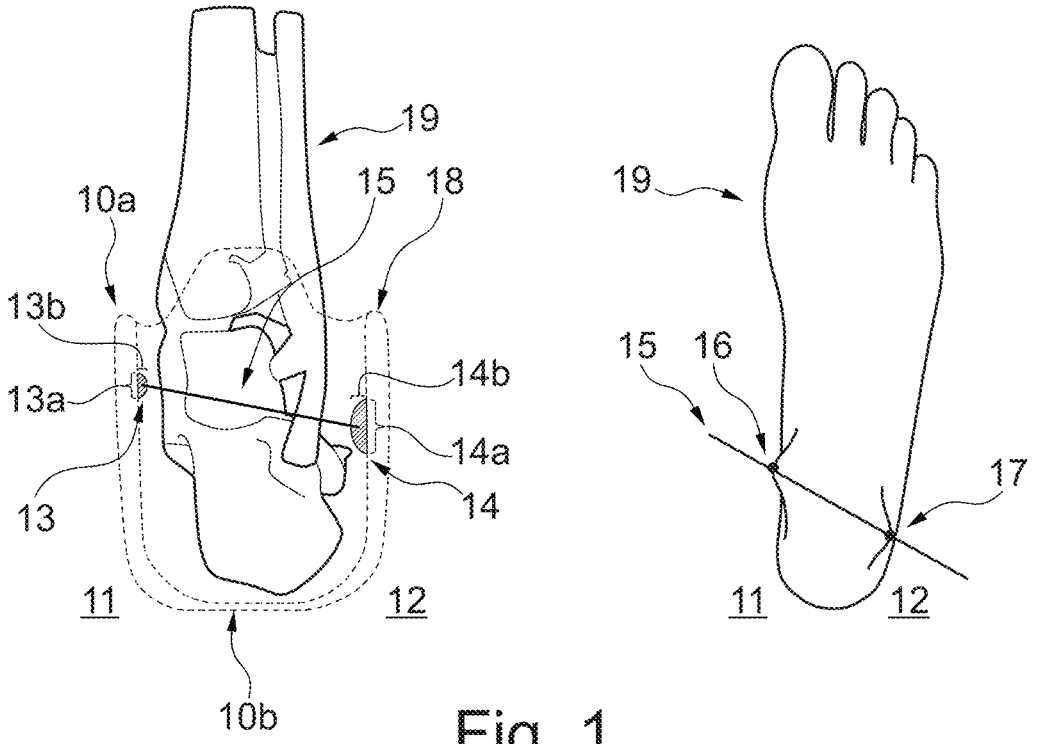
FIG. 1: A graphical illustration of an example of embodiments according to the present invention showing a cross section of a shoe upper with a medial padding and a lateral padding.

The above-mentioned problem is solved by an upper for a shoe, comprising: a medial padding located in a medial portion of a heel area of the upper, wherein the medial padding comprises a first shape, a lateral padding located in a lateral portion of the heel area of the upper, wherein the lateral padding comprises a second shape, wherein the first shape differs from the second shape, wherein the lateral padding is arranged closer to a sole of the shoe than the medial padding, and wherein the lateral padding is arranged closer to a rear of the shoe upper than the medial padding.

The medial and lateral shapes of the paddings correspond to the anatomical conditions of the ankle of a wearer. Since the medial and lateral side of the ankle have different anatomical conditions, the same shape would lead to a mismatch between the paddings and the ankle in general. A padding adapted to the respective anatomical condition of the medial or lateral side of the ankle ensures an ideal alignment between the padding and the ankle bone. Thereby, the space between the padding and the ankle bone may be minimized, which lead to a snug fit in the shoe. Through the snug fit, the freedom of movement of the foot may be significantly restricted in an area of the ankle, so that injuries and blisters in this area may be avoided or at least reduced. Further, a snug fit improves the transfer of energy of the foot in the shoe during stepping on and pushing off on a surface. In addition, the medial and lateral paddings are not arranged symmetrically. An asymmetric arrangement along the frontal and sagittal plane of the paddings further supports the stability of the musculoskeletal system of the wearer during walking which, for example, prevents a twisting in the direction of the medial or lateral side of the foot.

In the following, the arrangement of a padding closer to a sole of the shoe is denoted as lower level and the arrangement of being farther away from a sole of the shoe is denoted as higher level.

Especially in sports, like e.g., soccer, rugby or running, such a padding may be beneficial, since in such sports the risk of twisting the foot in the medial or lateral direction is high. Therefore, the upper according to the invention is, in some embodiments, an upper for a soccer shoe, an upper for a rugby shoe or an upper for a running shoe. Furthermore, a snug fit of the shoe and the ankle of a wearer is highly relevant for hiking or in sports where jumps are performed frequently like basketball. Thus, the upper according to the invention may be an upper for a hiking shoe or an upper for a basketball shoe.

According to the present invention, a horizontal extension of the medial padding measured in a frontal plane, i.e., its thickness, may be smaller than a thickness of the lateral padding. In some embodiments, a difference of the thickness of the medial padding and the lateral padding may be at least 4 mm. The thickness of a padding may be measured in a direction normal to the sagittal plane of a finished shoe upper, e.g., as it is connected to a sole structure to form a shoe.

Different vertical thicknesses of the paddings correspond to the anatomical conditions of the ankle bone on the medial and lateral side of the shoe and may therefore further stabilize the foot along the frontal plane and the sagittal plane. A medial padding that would comprise a large thickness would severely restrict the freedom of movement of the foot in the direction of the medial side and would lead to an inappropriate foot position. In addition, the probability of twisting in the direction of the lateral side would be greatly increased. Therefore, with a larger thickness of the lateral padding in comparison to the medial padding, a stabilization in the frontal plane may be achieve. Further, the larger thickness of the lateral padding provides a snug fit such that injuries due to too much space between the lateral padding and the lateral ankle, which would involve an increased rubbing, may be prevented. Therefore, through the snug fit of the ankle, the movement of the foot forwards and backwards may be reduced as well, which leads to a stabilization of the foot in the sagittal plane. Furthermore, the lateral side of the ankle which is more exposed than the medial side may be further protected from objects hitting the lateral side of the shoe.

A horizontal extension of the lateral padding measured in a sagittal plane, i.e., its length, may be less than a length of the medial padding. In some embodiments, a difference of the length of the medial padding and the lateral padding is at least 2 mm. The length of a padding may be measured in a direction normal to the frontal plane of a finished shoe upper, e.g., as it is connected to a sole structure to form a shoe.

Different lengths of the paddings correspond to the anatomical conditions of the ankle bones on the medial and lateral side of the shoe and may therefore further stabilize the foot in the frontal plane and in the sagittal plane. In particular, in the frontal plane, the foot may be stabilized such that a twisting in direction of the medial side may be prevented. Further, through the larger length of the medial padding, the medial ankle fits tighter to the medial padding, which may further reduce moving of the entire foot in the sagittal plane.

A vertical extension of the lateral padding measured in a frontal plane, i.e., its width, may be greater than a width of the medial padding measured in a frontal plane. In some embodiments, a difference of the width of the medial padding and the lateral padding may be at least 2 mm. In addition to the level difference of the lower lateral padding and the higher medial padding, the paddings may also comprise different widths. A width of a padding is defined as a distance from a bottom of the padding to a top of the same padding measured in a direction normal to the transversal plane of a finished shoe upper, e.g. as it is connected to a sole structure to form a shoe.

Different widths of the paddings correspond to the anatomical conditions of the ankle bone on the medial and lateral side of the shoe, the foot may be further stabilized in the frontal plane. In particular a twisting in the direction of the lateral side may be effectively minimized. Furthermore, the foot on the lateral side may be further supported by the bigger lateral padding. In addition, a more comfortable fit on the lateral and medial side may be achieved.

The volume of the medial padding may differ from the volume of the lateral padding. In some embodiments, the volume of the medial padding may be smaller than the volume of the lateral padding.

Different volumes of the medial and lateral paddings may further stabilize the foot of a wearer. Through the smaller volume of the medial padding, the freedom of movement of the foot on the medial side and simultaneously a snug fit on the lateral side may be guaranteed. Through the greater volume of the lateral padding, the lateral side of the ankle, in particular the lateral malleolus, which is in danger of being injured by another player's foot or object, may be further protected.

The lateral padding may be arranged at least 2 mm closer to a sole of the shoe than the medial padding.

Through the asymmetrical level arrangement of the paddings normal to the transversal plane a further stabilization of the ankle along the frontal plane may be achieved.

The lateral padding may be arranged at least 6 mm closer to a rear of the shoe upper than the medial padding.

Through the asymmetrical arrangement along the sagittal plane, the lateral padding, which is closer to a rear of the shoe than the medial padding, may reduce the movement of the foot forwards and backwards in the shoe. Therefore, this configuration ensures a stabilization of the foot especially along the sagittal plane. Furthermore, through the arrangement of the medial padding more away from the heel than the lateral padding, a further stabilization and support on the medial side may be achieved.

The medial padding and/or the lateral padding may comprise a foam material. The use of foam material offers many advantages. Firstly, they may be made from almost any plastic, which provides a wide range of properties. They are also light and easy to process, which is beneficial for shoes. Due to their low density, moisture may be transported away from the foot. In addition, foams are perceived as pleasant and soft. Foams may also help to keep the body temperature inside the shoe.

The medial padding and/or the lateral padding may comprise a pod. A padding, which comprises a pod may provide a more efficient damping. Further, the haptic experience may be improved. Furthermore, a pod may include a greater restoring force than ordinary foam to compensate misalignment of the foot or to protect the lateral side of the ankle, in particular the lateral malleolus, from forces acting from outside.

The pod may be filled with a liquid and/or a gas. Depending on which kind of filling is used, the haptic perception and/or the restoring force may be varied. Further, depending on the filling material, the body heat of the foot may be maintained or conducted away. Furthermore, a filled pod may better adapt to the respective individual shape of the wearer's foot.

The present invention also relates to a shoe comprising an upper as described herein and a sole attached to the upper. The shoe provides a snug fitting on the ankle and further stabilizes the foot of the wearer along the frontal plane and sagittal plane.

The present invention also relates to a method of manufacturing an upper for a shoe, comprising the following steps: arranging a medial padding in a medial portion of a heel area of the upper, wherein the medial padding comprises a first shape, arranging a lateral padding in a lateral portion of the heel area of the upper, wherein the lateral padding comprises a second shape, wherein the first shape differs from the second shape, arranging the lateral padding closer to a sole of the shoe than the medial padding, and arranging the lateral padding closer to a rear of the shoe upper than the medial padding.

The advantages of an upper obtained by such method have been described above and will not be repeated here for reasons of brevity The method may further comprise the steps: providing a compression mold with one cavity and two plates to create the pod in a compression molding process, filling the pod, and sealing the pod. This allows to produce the pod by molding in one manufacturing step. Molding is a simple and fast way of manufacturing, as several single steps may be realized in one step.

The method may further comprise the steps: forming the medial padding and/or the lateral padding in an embossing process using a first die and a second die, wherein the shape of the bottom of the first die corresponds to the top of the first shape and/or the second shape, and wherein the top of second die comprises a recess, which corresponds to the shape of the bottom of the first shape and/or the second shape. In the embossing process the dies may be exchanged or modularly composed such that a more complex pattern may be easily created. Through this, a visual design, for example trademarks or logos may be applied to the pod. Moreover, the pods may be provided with a specific texture to improve its haptic perception.

The material of the first die and/or the second die may comprise magnesium and/or copper and/or brass. In the embossing process the use of metals or metal alloys like magnesium, copper and brass is desirable, because they have a hardness that is sufficient to deform polymers. Furthermore, when applying the embossing process with heat these metals provide good thermal conduction.

The method may further comprise the steps: placing the material of the medial padding and/or the lateral padding between the first die and second die before performing the embossing process. Through the separate placing of the medial padding and/or lateral padding, different materials for the medial and lateral padding may be used. This provides a greater variety of the selected properties of the medial padding and the lateral padding.

The method may further comprise the steps: filling the material of the medial padding and/or the lateral padding between the first die and second die during performing the embossing press. Through the filling step the pod may be equipped with a plurality of desired properties.

Since the filling is realized during the embossing press, the processing time and the manufacturing effort may be decreased.

The material may be filled through rollers. Rollers may desirably enable assembly line production.

The embossing process may comprise the application of heat. By using heat, less pressure needs to be applied and the embossing process generally takes less time. In addition, the heat allows the pods to be sealed directly at the edges, which further reduces manufacturing steps and time.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Possible embodiments of the present invention will be described in the following detailed description primarily with reference to a shoe. It is emphasized, that the present invention is not limited by these embodiments.

FIG. 1 shows an upper 10*a* for a shoe 18 according to the present invention. Further, FIG. 1 shows a foot 19 inserted in the shoe 18 in a back view and—for reasons of illustration—a foot 19 in a top view. The shoe 18 comprises a medial padding 13 on the medial side 11 of the shoe 18 and a lateral padding 14 on the lateral side 12 of the shoe 18. The shape of the medial padding 13 and lateral padding 14 comprise a base shape of a semi-cylinder. However, in other embodiments the base shape of the medial padding and the lateral padding may vary fundamentally. For example, the base shape of the medial padding 13 may comprise a u-shape, a j-shape, a circular-shape, a torus-shape or any other suitable base shape, which is beneficial for the anatomical conditions of the medial side 16 of the ankle. Regardless of the shape of the medial padding 13, the lateral padding 14 may comprise one of the following base shapes: a u-shape, a j-shape, a circular-shape, a torus-shape or any other suitable base shape which is beneficial for the anatomical conditions of the lateral side 17 of the ankle.

The medial padding 13 and the lateral padding 14 are arranged at different levels as illustrated by the line 15 connecting the medial padding 13 and the lateral padding 14. This corresponds to the anatomical conditions of a human foot 19 and in particular to the anatomical conditions of the medial side 16 and the lateral side 17 of the ankle. Thereby, the lower end of the medial padding 13 is arranged at a level of 24 mm measured from the sole 10*b* of the shoe 18 and the lower end of the lateral padding 14 is arranged at a level of 20 mm measured from the sole of the shoe 18. In other embodiments the levels of the paddings may vary depending on the shoe type, size, intended use, etc.

In other embodiments, the medial padding 13 is arranged at a higher level than the lateral padding 14 by at least 2 mm. This specific asymmetry, caused by the higher medial padding 13 and the lower lateral padding 14 as measured in a frontal plane, leads to a stabilization of the foot 19 in the frontal plane. A twisting of the foot 19, in particular a twisting to the medial side 11 may be prevented by the arrangement of a higher medial padding 13. Further, an arrangement of a lower lateral padding 14 may prevent the lateral side of the ankle 17 and the lateral side 12 of the ankle 17 of an athlete from injuries caused by another athlete's foot or object.

The medial padding 13 comprises a vertical extension 13*b* measured in a frontal plane, i.e. a thickness, of 6 mm and the lateral padding 14 comprises a thickness of 10 mm. In further embodiments the thicknesses 13*b* and 14*b* of the medial padding 13 and lateral padding 14 may vary depending on the shoe type. In some embodiments, the thickness 14*b* of the lateral padding 14 is greater than the thickness 13*b* of the medial padding 13 by at least 4 mm. This specific configuration of the medial padding 13 and the lateral padding 14 supports the foot and further provides a snug fit.

The paddings comprise a width, which is defined from the bottom of the padding to the top of the same padding normal to the transversal plane. In the exemplary embodiment of FIG. 1, the medial padding 13 comprises a width 13*a* of 10 mm measured in the frontal plane and the lateral padding 14 comprises a width 14*a* of 12 mm measured in the frontal plane. In other embodiments the widths 13*a*, 14*a* of the medial padding 13 and lateral padding 14 may vary depending on the shoe type. In some embodiments, the width 14*a* of the lateral padding 14 is greater than the width 13*a* of the medial padding 13 by at least 2 mm. This specific width configuration of the medial padding 13 and the lateral padding 14 provides a further stabilization in the frontal plane of the foot 19.

Further, as shown in FIG. 1, the volume of the medial padding 13 is less than the volume of the lateral padding 14. Through the different volumes the athlete gets a better support and stability perception, in particular while running.

Figure 2:
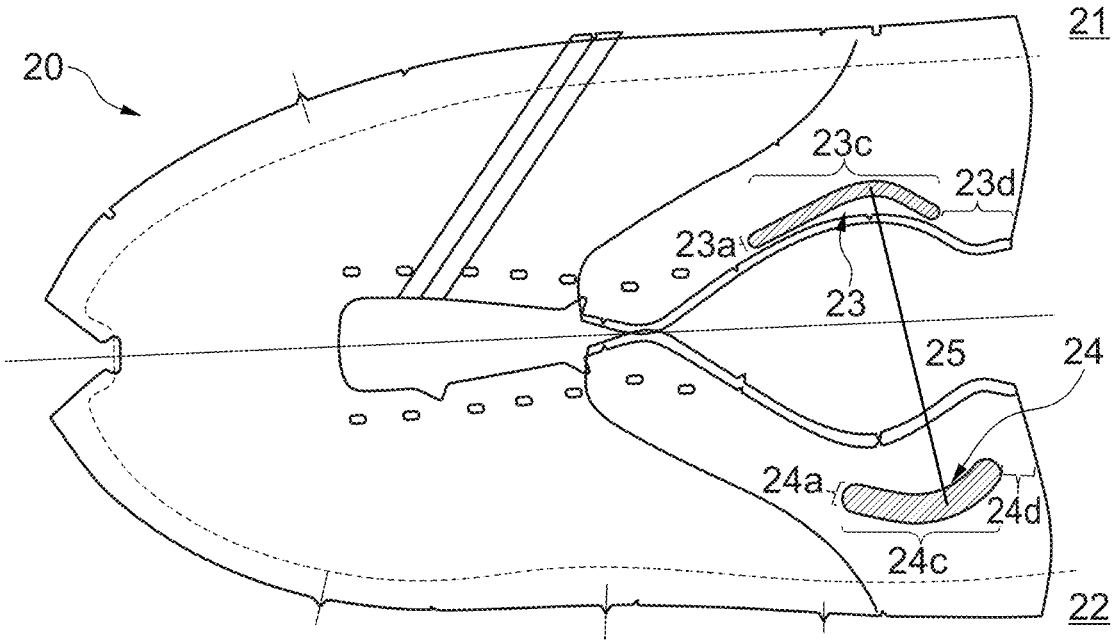
FIG. 2: Another graphical illustration of embodiments showing a shoe upper with a medial padding and a lateral padding according to the present invention.

Since a horizontal extension of the paddings in the sagittal plane, i.e., their lengths, are not shown in FIG. 1, these aspects are described in FIG. 2 more in detail.

FIG. 2 shows an embodiment of an upper 20 for a soccer shoe. In other embodiments the upper 20 may be for example for a rugby shoe, a running shoe, a hiking shoe or a basketball shoe, etc. The upper 20 comprises a medial padding 23 on the medial side 21 and a lateral padding 24 on the lateral side 22 of the upper 20. The medial padding 23 comprises a flat j-shape base shape and the lateral padding 24 comprises a flat u-shape base shape. Generally, the medial padding 23 and the lateral padding 24 may comprise different base shapes or the same base shapes and may comprise different shapes than those shown in FIG. 2.

In the exemplary embodiment of FIG. 2, the medial padding 23 is arranged at a distance of 18 mm from a rear 23*d* of the upper 20 along the sagittal plane and the lateral padding 24 is arranged at a distance of 8 mm from the rear 24*d* of the shoe 18 along the sagittal plane. In other embodiments the arrangement 23*d*, 24*d* of the medial padding 23 and lateral padding 24 may vary depending on the shoe type, size, intended use, etc. In some embodiments, the medial padding 23 is further away from the rear 23*d* of the upper 20 than the lateral padding 24, 24*d* by at least 6 mm. This leads to an asymmetry, illustrated by the line 25 (corresponding to the asymmetry of the ankle as illustrated by line 15 in FIG. 1), along the sagittal plane, which further prevents a twisting to the medial side 21 and too much moving of a foot in the upper 20 along the sagittal plane. Therefore, this specific asymmetry—as illustrated by the line 25—along the sagittal plane further stabilizes the foot in the shoe in the frontal plane and the sagittal plane.

The medial padding 23 comprises a width 23*a* of 10 mm measured in the frontal plane and the lateral padding 24 comprises a width 24*a* of 12 mm measured in the frontal plane of the finished shoe upper, i.e., as it is connected to a sole to form a finished shoe. In the exemplary embodiment of FIG. 2, the medial padding 23 is arranged at a level of 24 mm measured from the bottom border of the upper 20 and the lateral padding 24 is arranged at a level of 20 mm measured from the bottom border of the upper 20. In this embodiment the medial padding 23 is closer to a collar portion of the upper 20 than the lateral padding 24.

The medial padding 23 comprises a horizontal extension 23*c* of 24 mm measured in the sagittal plane and the lateral padding 24 comprises a horizontal extension 24*c* of 22 mm measured in the sagittal plane. A horizontal extension of a padding is also denoted as a length of a padding. In further embodiments the lengths 23*c*, 24*c* of the medial padding 23 and lateral padding 24 may vary depending on the shoe type, size, intended use, etc. In some embodiments, the length 23*c* of the medial padding 23 is greater than the length 24*c* of the lateral padding 24 by at least 2 mm. This specific length configuration of the upper 20 provides a further stabilization of the foot along the sagittal plane and the frontal plane.

Therefore, a twisting to the medial side 21 and a moving forward and backwards of the foot in the finished upper 20 may be significantly reduced. Although, the medial padding 23 is longer 23*c* than the lateral padding 24, 24*c*, the volume of the medial padding 23 is less than the volume of the lateral padding 24.

Due to the two-dimensional top view, the thickness of the medial padding 23 and the lateral padding 24 is not shown in FIG. 2. The asymmetry along the frontal plane is only recognizable due to the distance from the paddings to the collar portion. Therefore, these aspects are described more in detail with respect to FIG. 1.

Figure 3:
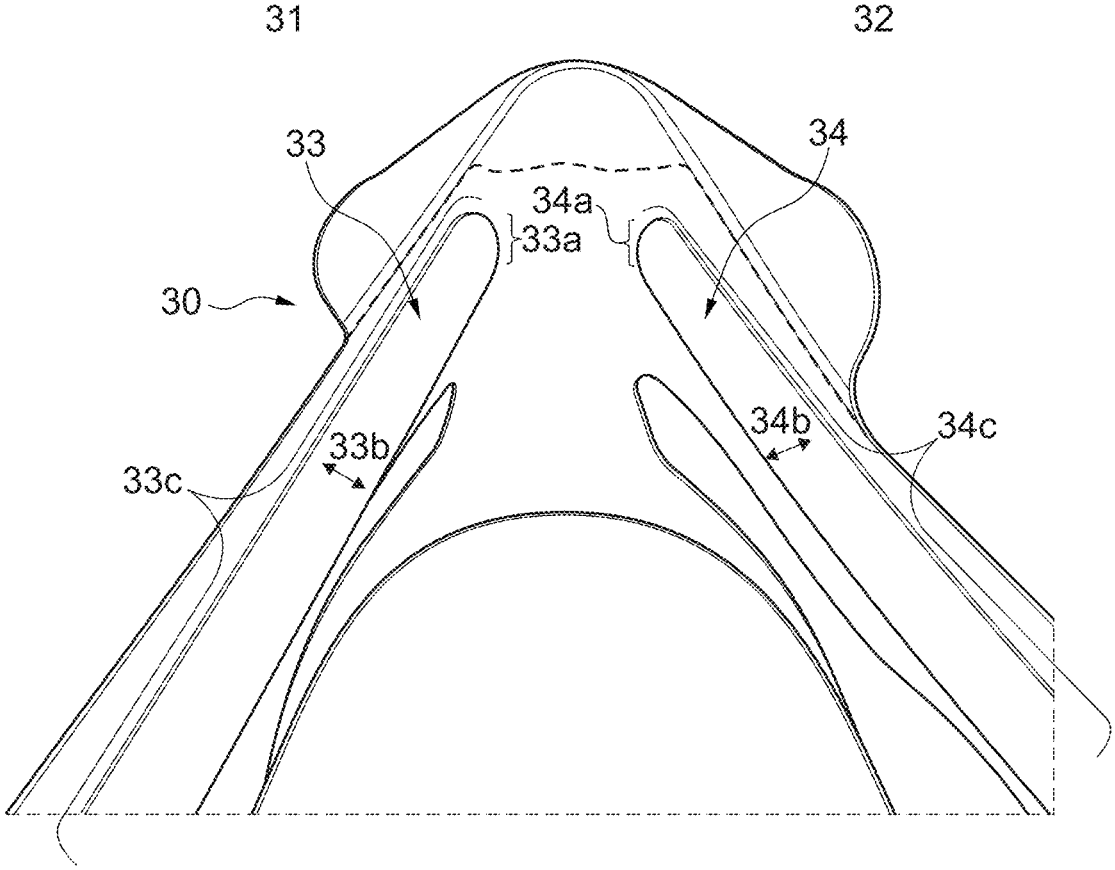
FIG. 3: Another example of embodiments showing a shoe with a medial pod and a lateral pod.

FIG. 3 shows part of a shoe 30 according to the present invention. The shoe 30 comprises on the medial side 31 a medial pod 33 and a lateral pod 34 on the lateral side 32. The lateral pod 34 extends closer to the rear of the shoe 30 than the medial pod 33. Further, the lateral pod 34 comprises a greater thickness 34*b* than the thickness 33*b* of the medial pod 33. The medial pod 33 is located higher than the lateral pod 34 as measured from the sole of the shoe 30. The medial and lateral pods 33, 34 comprise foam material. In further embodiments the foam material may comprise memory foam. The size of the medial pod 33 and lateral pod 34 may vary depending on the shoe type and the intended use. In one embodiment, a running shoe is considered, where the medial pod 33 comprises a length 33*c* of 68 mm and the lateral pod 34 comprises a length 34*c* of 62 mm. Further, the medial pod 33 comprises a width 33*a* of 10 mm and the lateral pod 34 comprises a width 34*a* of 14 mm. Furthermore, the medial pod 33 comprises a thickness 33*b* of 8 mm and the lateral pod 34 comprises a thickness 34*b* of 10 mm. In further embodiments, where other shoe types are considered like for example basketball shoes or hiking shoes, the size may vary with respect to the size relations between the medial pod 33 and the lateral pod 34 according to the present invention.

The medial pod 33 and the lateral pod 34 are filled with foam. The foam is made of polyurethane (PUR) foam with a density of 80 kg/m$^3$. In further embodiments the medial pod 33 and the lateral pod 34 may comprise a different hardness. In this embodiment, the PUR foam has high rebound properties, which improves the fitting and therefore the stability and the energy transmission of the foot in the shoe. In other embodiments, the pods may have less rebound and therefore greater memory properties, such that they may perfectly align to the ankle of a wearer, which improves the wearing comfort. In general, the dynamic interaction properties of the pods in contact with other objects may vary depending on the shoe type and the intended use. In further embodiments the medial pod 33 may comprise different memory and/or rebound properties than the lateral pod 34.

The medial pod 33 and the lateral pod 34 are manufactured in an emboss process with a first and a second die. The material of the dies may comprise copper, magnesium or brass depending on the design of the pods. In further embodiments, the material of the first die may be different from the material of the second die. The bottom shape of the first die corresponds to the top of the shape of the medial pod 33 or the lateral pod 34. The top surface of the second die has a recess, which corresponds to the shape of the bottom of the medial pod 33 and/or lateral pod 34. The first die and the second die are customized with the intended design following the exact size of the foam pods. In this embodiment, the pods are filled with PUR foam. Therefore, the PUR foam is placed between the first and second die and subsequently the emboss process is performed by applying a heat of 125 degrees Celsius. Thereby, a baker between the first and second die and the foam is used, which is composed of laminated velvetex.

An additional layer may be used to cover the PUR foam. In some embodiments, the additional layer comprises a soft haptic material. In other embodiments, the additional layer may comprise a material with a grippy and/or rough surface, having e.g. fibers oriented in one direction, including in some embodiments, toward the bottom of the shoe. This fiber configuration of the material of the layer further increases the grip between the material and a wearer's socks and further minimizes the movement of the foot, in particular the heel, in the shoe. In some embodiments, the additional layer is only placed on one side of the foam in the emboss process, namely the side, which is in direct contact with a foot of the wearer. In further embodiments, the additional layer may also be placed on the side which will be attached to the upper of the shoe. In other embodiments, the material of the additional layer may vary depending on which side of the shoe upper it is used.

In further embodiments, other materials than PUR foam may be used as far the material is suitable to form a 3-dimensional structure. The material to be pressed may be placed between the first die and second die before the emboss process is applied, which is denoted as "clamshell press". In further embodiments, the material may also be filled during the emboss process, wherein the material is filled in the press and comes out on the other side, denoted as "straight stamp press". If the filling of the material is realized with rollers, then the process is denoted as "roll press". After finishing the emboss process, the manufactured medial pod 33 and lateral pod 34 are attached to the shoe 30.

In another embodiment, the pods may be filled with a liquid and/or gas. This is realized in a different manufacturing process. A vacuum forming machine using a top mold and a bottom mold with a cavity is provided. Thereby, the shape of the pod to be manufactured corresponds to the cavity of the bottom mold, which in some embodiments, is a three-dimensional semi-circle. In further embodiments the shape may comprise any suitable shape to support and hug the ankle, like, for example, a three-dimensional j-shape, three-dimensional u-shape, a torus shape, etc. In the first step, a first sheet of thermoplastic polyurethane (TPU) with a thickness of 0.8 mm is placed on top of the bottom mold. In further embodiments, other materials with other thicknesses may be used, depending on the shoe type and purposes of the pods. In the second step, heat is applied until the first sheet reaches a suitable forming temperature and becomes pliable. In the third step, the pliable first sheet is exposed to vacuum.

Due to the vacuum, the pliable first sheet on the bottom mold extends/is pulled towards the cavity of the bottom mold. To achieve an effectively pull towards the cavity of the bottom mold, the bottom mold is provided with tiny holes, which are drilled into the crevices. Through this, an appropriate pod-shaped structure of the first sheet is obtained. Subsequently, the formed pod-shaped structure in the bottom mold is cooled down. In the fourth step, the pod-shaped structure is poured and filled with filler material, in some embodiments, polyurethane (PU). In further embodiments, the filler material may comprise other liquids (e.g., waterlike liquids, recycled compounds, etc.) or gas that is suitable to adapt and hug the shape of the ankle bones. In the next step, the poured and filled pod-shaped structure is covered with a second sheet, in some embodiments, made of TPU. In further embodiments, the second sheet may comprise a different material than the first material. Subsequently, the pod-shaped structure is sealed by pressing the top mold against the bottom mold. The obtained filled pod is then placed into a heated chamber of 50-60 degrees Celsius for 24 hours. After the heating, the edges of the filled pod are cut and trimmed, such that the edges are eliminated from protruding material and uneven areas. The finalized filled pod is then attached to an upper for a shoe.

In the following, further examples are described to facilitate the understanding of the invention:

Example 1. An upper (10*a*; 20) for a shoe (18), comprising: a) a medial padding (13; 23) located in a medial portion of a heel area of the upper (10*a*; 20), wherein the medial padding (13; 23) comprises a first shape; b) a lateral padding (14; 24) located in a lateral portion of the heel area of the upper (10*a*; 20), wherein the lateral padding (14; 24) comprises a second shape; c) wherein the first shape differs from the second shape, d) wherein the lateral padding (14; 24) is arranged closer to a sole (10*b*) of the shoe (18) than the medial padding (13; 23), and e) wherein the lateral padding (14; 24) is arranged closer to a rear of the shoe (18) upper (10*a*; 20) than the medial padding (13; 23).

Example 2. The upper (10*a*; 20) according to Example 1, wherein a horizontal extension of the medial padding (13; 23) measured in a frontal plane, i.e., its thickness (13*b*), is smaller than a thickness (14*b*) of the lateral padding (14; 24).

Example 3. The upper (10*a*; 20) according to Example 2, wherein a difference of the thickness (13*b*, 14*b*) of the medial padding (13; 23) and the lateral padding (14; 24) is at least 4 mm.

Example 4. The upper (10*a*; 20) according to one of Examples 1-3, wherein a horizontal extension of the lateral padding (14; 24) measured in a sagittal plane, i.e., its length (24*c*), is less than a length (23*c*) of the medial padding (13; 23).

Example 5. The upper (10*a*; 20) according to Example 4, wherein a difference of the length (23*c*, 24*c*) of the medial padding (13; 23) and the lateral padding (14; 24) is at least 2 mm.

Example 6. The upper (10*a*; 20) according to one of the Examples 1-5, wherein a vertical extension of the lateral padding (14; 24) measured in a frontal plane, i.e., its width (14*a*; 24*a*), is greater than a width (13*a*; 23*a*) of the medial padding (13; 23).

Example 7. The upper (10*a*; 20) according to Example 6, wherein a difference of the width (13*a*, 14*a*; 23*a*, 24*a*) of the medial padding (13; 23) and the lateral padding (14; 24) is at least 2 mm.

Example 8. The upper (10*a*; 20) according to one of Examples 1-7, wherein the volume of the medial padding (13; 23) differs from the volume of the lateral padding (14; 24).

Example 9. The upper (10*a*; 20) according to Example 8, wherein the volume of the medial padding (13; 23) is smaller than the volume of the lateral padding (14; 24).

Example 10. The upper (10*a*; 20) according to one of Examples 1-9, wherein the lateral padding (14; 24) is arranged at least 2 mm closer to a sole (10*b*) of the shoe (18) than the medial padding (13; 23).

Example 11. The upper (10*a*; 20) according to one of Examples 1-10, wherein the lateral padding (14; 24) is arranged at least 6 mm closer to a rear of the shoe (18) upper (10*a*; 20) than the medial padding (13; 23).

Example 12. The upper (10*a*; 20) according to one of Examples 1-11, wherein the medial padding (13; 23) and/or the lateral padding (14; 24) comprises a foam material.

Example 13. The upper (10*a*; 20) according to one of Examples 1-12, wherein the medial padding (13; 23) and/or the lateral padding (14; 24) comprises a pod.

Example 14. The upper (10*a*; 20) according to Example 13, wherein the pod is filled with a liquid and/or a gas.

Example 15. A shoe (18) comprising: an upper (10*a*; 20) for a shoe (18) according to one of Examples 1-14; and a sole (10*b*) attached to the upper (10*a*; 20).

Example 16. A method of manufacturing an upper (10*a*; 20) for a shoe (18), comprising: a) arranging a medial padding (13; 23) in a medial portion of a heel area of the upper (10*a*; 20), wherein the medial padding (13; 23) comprises a first shape; b) arranging a lateral padding (14; 24) in a lateral portion of the heel area of the upper (10*a*; 20), wherein the lateral padding (14; 24) comprises a second shape, c) wherein the first shape differs from the second shape; d) arranging the lateral padding (14; 24) closer to a sole (10*b*) of the shoe (18) than the medial padding (13; 23), and e) arranging the lateral padding (14; 24) closer to a rear of the shoe upper (10*a*; 20) than the medial padding (13; 23).

Example 17. The method of manufacturing an upper (10*a*; 20) for a shoe (18) according to Example 16, wherein a horizontal extension of the medial padding (13; 23) measured in a frontal plane, i.e., its thickness (13*b*), is smaller than the thickness (14*b*) of the lateral padding (14; 24).

Example 18. The method of manufacturing an upper (10*a*; 20) for a shoe according to Example 17, wherein a difference of the thickness (13*b*, 14*b*) of the medial padding (13; 23) and the lateral padding (14; 24) is at least 4 mm.

Example 19. The method of manufacturing an upper (10*a*; 20) for a shoe (18) according to one of Examples 16-18, wherein a horizontal extension of the lateral padding (14; 24) measured in a sagittal plane, i.e., its length (24*c*), is less than a length (23*c*) of the medial padding (13; 23).

Example 20. The method of manufacturing an upper (10*a*; 20) for a shoe (18) according to Example 19, wherein a difference of the length (23*c*, 24*c*) of the medial padding (13; 23) and the lateral padding (14; 24) is at least 2 mm.

Example 21. The method of manufacturing an upper (10*a*; 20) for a shoe (18) according to one of Examples 16-20, wherein a vertical extension of the lateral padding (14; 24) measured in a frontal plane, i.e., its width (14*a*; 24*a*), is greater than a width (13*a*; 23*a*) of the medial padding (13; 23).

Example 22. The upper (10*a*; 20) according to Example 21, wherein a difference of the width (13*a*, 14*a*; 23*a*, 24*a*) of the medial padding (13; 23) and the lateral padding (14; 24) is at least 2 mm.

Example 23. The method of manufacturing an upper (10*a*; 20) for a shoe (18) according to one of Examples 16-22, wherein the volume of the medial padding (13; 23) differs from the volume of the lateral padding (14; 24).

Example 24. The method of manufacturing an upper (10*a*; 20) for a shoe (18) according to Example 23, wherein the volume of the medial padding (13; 23) is smaller than the volume of the lateral padding (14; 24).

Example 25. The method of manufacturing an upper (10*a*; 20) for a shoe (18) according to one of Examples 16-24, wherein the lateral padding (14; 24) is arranged at least 2 mm closer to a sole (10*b*) of the shoe (18) than the medial padding (13; 23).

Example 26. The method of manufacturing an upper (10*a*; 20) for a shoe (18) according to one of Examples 16-25, wherein the lateral padding (14; 24) is arranged at least 6 mm closer to a rear of the shoe upper (10*a*; 20) than the medial padding (13; 23).

Example 27. The method of manufacturing an upper (10*a*; 20) for a shoe (18) according to one of Examples 16-26, further comprising the step: providing the medial padding (13; 23) and/or lateral padding (14; 24) with a foam material.

Example 28. The method of manufacturing an upper (10*a*; 20) for a shoe (18) according to one of Examples 16-27, further comprising the step: providing the medial padding (13; 23) and/or the lateral padding (14; 24) with a pod.

Example 29. The method of manufacturing an upper (10*a*; 20) for a shoe (18) according to Example 28, further comprising the step: filling the pod with a liquid and/or a gas.

Example 30. The method of manufacturing an upper (10*a*; 20) for a shoe (18) according to one of Examples 28-29, further comprising the steps: providing a vacuum forming machine having a top mold and a bottom mold with a cavity; placing a first sheet on the bottom mold; pulling a portion of the sheet into the bottom mold using vacuum applied to the cavity of the bottom mold to obtain a pod-shaped structure; filling the pod-shaped structure with a filler material; covering the filled pod-shaped structure with a second sheet; and sealing the pod-shaped structure by pressing the top mold against the bottom mold to obtain a filled pod.

Example 31. The method of manufacturing an upper (10*a*; 20) for a shoe (18) according to one of the Examples 16-27, further comprising the steps: forming the medial padding (13; 23) and/or the lateral padding (14; 24) in an embossing process using a first die and a second die, wherein the shape of the bottom of the first die corresponds to the top of the first shape and/or the second shape, and wherein the top of second die comprises a recess, which corresponds to the shape of the bottom of the first shape and/or the second shape.

Example 32. The method of manufacturing an upper (10*a*; 20) for a shoe (18) according to one of Examples 16-31, wherein the material of the first die and/or the second die comprises magnesium and/or copper and/or brass.

Example 33. The method of manufacturing an upper (10*a*; 20) for a shoe (18) according to one of the Examples 16-32, further comprising the step: placing the material of the medial padding (13; 23) and/or the lateral padding (14; 24) between the first die and second die before performing the embossing process.

Example 34. The method of manufacturing an upper (10*a*; 20) for a shoe (18) according to one of the Examples 16-33, further comprising the step: filling the material of the medial padding (13; 23) and/or the lateral padding (24; 24) between the first die and second die during performing the embossing press.

Example 35. The method of manufacturing an upper (10*a*; 20) for a shoe (18) according to Example 34, wherein the material is filled through rollers.

Example 36. The method of manufacturing an upper (10*a*; 20) for a shoe (18) according to one of the Examples 16-35, wherein the embossing process comprises the application of heat.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

The invention claimed is:

1. An upper for a shoe, comprising:

a) a medial padding located in a medial portion of a heel area of the upper, wherein the medial padding comprises a first shape;

b) a lateral padding located in a lateral portion of the heel area of the upper, wherein the lateral padding comprises a second shape;

c) wherein the first shape differs from the second shape, d) wherein the lateral padding is arranged closer to a bottom border of the upper than the medial padding, e) wherein the lateral padding is arranged closer to a rear of the shoe upper than the medial padding;

f) wherein the volume of the medial padding differs from the volume of the lateral padding, and wherein the volume of the medial padding is smaller than the volume of the lateral padding; and g) wherein a topmost extent of the medial padding is higher than a topmost extent of the lateral padding relative to the bottom border of the upper.

2. The upper according to claim 1, wherein a medial padding thickness is smaller than a thickness of the lateral padding.

3. The upper according to claim 2, wherein a difference of the thickness of the medial padding and the lateral padding is at least 4 mm.

4. The upper according to claim 1, wherein a lateral padding length is less than a length of the medial padding.

5. The upper according to claim 4, wherein a difference of the length of the medial padding and the lateral padding is at least 2 mm.

6. The upper according to claim 1, wherein width of the lateral padding is greater than a width of the medial padding.

7. The upper according to claim 6, wherein a difference of the width of the medial padding and the lateral padding is at least 2 mm.

8. The upper according to claim 1, wherein the lateral padding is arranged at least 2 mm closer to the bottom border of the upper than the medial padding.

9. The upper according to claim 1, wherein the lateral padding is arranged at least 6 mm closer to the rear of the shoe upper than the medial padding.

10. The upper according to claim 1, wherein at least one of the medial padding or the lateral padding comprises a foam material.

11. The upper according to claim 1, wherein the medial padding and/or the lateral padding comprises a pod.

12. The upper according to claim 11, wherein the pod is filled with a liquid.

13. The upper according to claim 11, wherein the pod is filled with a gas.

14. A shoe comprising:

an upper for a shoe according to claim 1; and a sole attached to the upper.

15. The upper according to claim 1, wherein a rear medial distance between a rearmost portion of the medial padding and the rear of the shoe upper is at least two times longer than a rear lateral distance between a rearmost portion of the lateral padding and the rear of the shoe.

16. An upper for a shoe, comprising:

a) a medial padding located in a medial portion of a heel area of the upper, wherein the medial padding comprises a first shape;

b) a lateral padding located in a lateral portion of the heel area of the upper, wherein the lateral padding comprises a second shape;

c) wherein the first shape differs from the second shape, d) wherein the lateral padding is arranged closer to a bottom border of the upper than the medial padding, e) wherein the lateral padding is arranged closer to a rear of the shoe upper than the medial padding;

f) wherein the volume of the medial padding differs from the volume of the lateral padding, and wherein the volume of the medial padding is smaller than the volume of the lateral padding; and g) wherein a rear medial distance between a rearmost portion of the medial padding and the rear of the shoe upper is at least two times longer than a rear lateral distance between a rearmost portion of the lateral padding and the rear of the shoe.

17. A method of manufacturing an upper for a shoe, comprising:

a) arranging a medial padding in a medial portion of a heel area of the upper;

wherein the medial padding comprises a first shape;

b) arranging a lateral padding in a lateral portion of the heel area of the upper, wherein the lateral padding comprises a second shape, c) wherein the first shape differs from the second shape;

d) arranging the lateral padding closer to a bottom border of the upper than the medial padding, and e) arranging the lateral padding closer to a rear of the shoe upper than the medial padding;

f) wherein the volume of the medial padding differs from the volume of the lateral padding, and wherein the volume of the medial padding is smaller than the volume of the lateral padding; and g) wherein at least one of:

a topmost extent of the medial padding is higher than a topmost extent of the lateral padding relative to the bottom border of the upper; or a rear medial distance between a rearmost portion of the medial padding and the rear of the shoe upper is at least two times longer than a rear lateral distance between a rearmost portion of the lateral padding and the rear of the shoe.

18. The method according to claim 17, wherein a rear medial distance between a rearmost portion of the medial padding and the rear of the shoe upper is at least two times longer than a rear lateral distance between a rearmost portion of the lateral padding and the rear of the shoe.

19. The method according to claim 17, wherein a topmost extent of the medial padding is higher than a topmost extent of the lateral padding relative to the bottom border of the upper.

20. The method according to claim 17, further comprising the step:

providing the medial padding and/or the lateral padding with a pod.

21. The method according to claim 20, further comprising the steps:

providing a vacuum forming machine having a top mold and a bottom mold with a cavity;

placing a first sheet on the bottom mold;

pulling a portion of the first sheet into the bottom mold using vacuum applied to the cavity of the bottom mold to obtain a pod-shaped structure;

filling the pod-shaped structure with a filler material;

covering the filled pod-shaped structure with a second sheet; and sealing the pod-shaped structure by pressing the top mold against the bottom mold to obtain a filled pod.

* * * * *